United States Patent [19]

Lewis

[11] 4,152,853

[45] May 8, 1979

[54] MULTIPLE SHUTTER DIGITAL DEVICE

[76] Inventor: Robert L. Lewis, 393 E. McKinley, Sunnyvale, Calif. 94086

[21] Appl. No.: 840,580

[22] Filed: Oct. 11, 1977

[51] Int. Cl.[2] ..... G09F 9/30

[52] U.S. Cl. ..... 40/451; 40/437; 58/126 E

[58] Field of Search ..... 40/451, 450, 447, 474, 40/433, 437; 340/336, 378 R, 366 R, 366 A–366 E; 58/125 B, 125 C, 126 A, 126 E, 52 R

[56] References Cited

U.S. PATENT DOCUMENTS

| | | | |
|---|---|---|---|
| 755,272 | 3/1904 | Burnham | 40/450 |
| 3,363,347 | 1/1968 | Benson | 340/336 X |
| 3,399,475 | 9/1968 | Rinder | 40/451 |
| 3,683,523 | 8/1972 | Boyles | 40/451 |
| 3,721,087 | 3/1973 | Boyles et al. | 58/126 E |
| 3,825,923 | 7/1974 | Pirchl | 340/336 |
| 3,831,303 | 8/1974 | Funaki | 40/450 |
| 3,965,668 | 6/1976 | Tomokazu et al. | 58/126 E |
| 3,990,165 | 11/1976 | Vogt | 40/447 |
| 4,021,944 | 5/1977 | Trame | 40/474 X |
| 4,047,314 | 9/1977 | Slack et al. | 40/447 |

*Primary Examiner*—John F. Pitrelli
*Attorney, Agent, or Firm*—Schatzel & Hamrick

[57] ABSTRACT

A multiple shutter device for displaying digital information and including an opaque face plate having a plurality of transparent windows situated thereon, a shutter support plate facing and closely disposed behind the face plate and having a plurality of opaque shutters situated thereon, each shutter in unique alignment with one of the segment windows, a multi-track grooved rotary cam facing and closely disposed behind the shutter support plate, a plurality of cam follower arms each being pivotally attached to one of the shutters at a first end and having a second end provided with a cam track following pin which engages a track on the cam, each arm further having a point intermediate the first and second ends which is pivotally attached to the shutter plate, whereby rotation of the cam causes various combinations of the shutter to be actuated to open and close the segment windows and sequentially display one or more digital characters.

10 Claims, 5 Drawing Figures

MULTIPLE SHUTTER DIGITAL DEVICE

BACKGROUND OF THE INVENTION

1. Field of the Invention

The present invention relates generally to digital display devices and more particularly to mechanical digital display devices having a plurality of transparent windows selectively shutterable by mechanical cam means.

2. Discussion of the Prior Art

Digital displays, or readouts, have found favor in many modern day applications as being among the most efficient means of quickly and accurately visually transmitting information. Everyday applications of visual displays include the light emitting diode or liquid crystal displays found in digital watches and calculators and the large light matrixes used for displaying scores at football, basketball and other sporting games.

The aforementioned digital display types are either electrical or electronic in nature. Another type of digital display device, particularly suited for large displays, is the mechanical or electro-mechanical digital display.

A couple of interesting mechanical digital displays are disclosed by Pirchl in U.S. Pat. No. 3,825,923, a first of which comprises an opaque face plate having a seven segment window formed thereon, behind which a visual surface having a series of vertical and transverse lines printed or otherwise fashioned on its surface is disposed and which may then be positioned under the seven segment windows to provide a seven segment display of digital numerals. A second type of visual display disclosed in the same patent comprises a plurality of flexible tongues which may be forced together by an externally situated cam to produce a digital readout.

Another mechanical digital display has an opaque face plate having seven segment or seven segment type windows behind which masks are moved relative to the faceplate, producing a patterned digital display when a light is shined through. An example of this type of device, disclosed by Trame in U.S. Pat. No. 4,021,944, uses a system of gears, eccentrics and slots to orbitally position a mask relative a face plate. Another example of this type of mechanical digital display, disclosed by Rinder in U.S. Pat. No. 3,399,475 has four masks independently moveable relative a face plate to provide a patterned digital display.

Another type of digital display device, disclosed by Vogt in U.S. Patent Application No. B493,981, has a number of geometrically-shaped screens which are moved by a cam and lever system across and about a background of contrasting color or shade.

While the digital displays found in the prior art admirably fulfill their function, they do possess a number of drawbacks. A common drawback of digital displays found in the prior art is that they are invariably mechanically complex, which, of course, leads to an increase in cost of the device and a greater chance for it to break down or otherwise malfunction. Furthermore, a number of the displays cannot show conventional digital or seven segment numerals due to various design considerations.

Another drawback with prior art digital displays is that they are not often directly actuable by rotary means, proving them of limited suitability for such purposes as digital clock displays.

Yet another disadvantage with digital displays found in the prior art is that they cannot always be back lighted, which would reduce their visibility in applications such as outdoor stadium display boards.

SUMMARY OF THE INVENTION

It is an object of this invention to produce a digital display that is relatively simple mechanically, and which has standard digital seven segment numerals for ease of readability and comprehension.

A further object of this invention is to provide a visual display which may be back lighted for easy visibility under low light or distal reading conditions.

It is yet another object of this invention to provide a digital display which may be easily actuable by rotary means such as clock drive motors.

Briefly, the present invention includes an opaque face plate having a plurality of transparent segment windows situated thereon in a seven segment digital pattern, a shutter support plate having a plurality of shutters located thereon, each in removable alignment with a unique segment window, a rotary cam shutter actuator, having a plurality of grooved tracks formed on a first surface, facing and disposed closely behind said shutter housing and display plate, a plurality of cam follower arms, each one associated with a shutter, and having a first end pivotally connected to one of said shutters and having a second end attached to a cam track following pin which engages a track on the cam, and having a point intermediate its first and second ends pivotally connected to the shutter support plate, where the shutters are positionally responsive to the rotation of the cam due to the action of the follower arms and form a digital display by selectively shuttering and unshuttering segment windows.

An advantage of the present invention is that the support plate does not move relative the face plate as a mask would, thereby eliminating need for cams, gears, eccentrics, etc., to reposition the two relative each other.

Another advantage of the present invention is that the digital display is always clearly visible because the shutters completely retract from the segment windows to allow for their full illumination.

A further advantage of the present invention is that the rotary cam is able to be directly driven by a standard clock drive so that the display may be used to digitally display time in a convenient and accurate manner.

Yet another advantage of the present invention is that the digital display may easily be back lighted for greater visibility under adverse conditions.

IN THE DRAWING

FIG. 1 is an exploded perspective view of a multiple digital device in accordance with the present invention, FIG. 2 is a plan view further illustrating a rotary cam shown in FIG. 1, FIG. 3 is a front elevation broken away to further illustrate the multiple shutter digital device shown in FIG. 1, FIG. 4 is a partial cross section taken along line 4—4 of FIG. 3, and FIG. 5 is a pictorial representation of the shutter mechanism in accordance with the present invention.

DESCRIPTION OF THE PREFERRED EMBODIMENT

Figure 1:
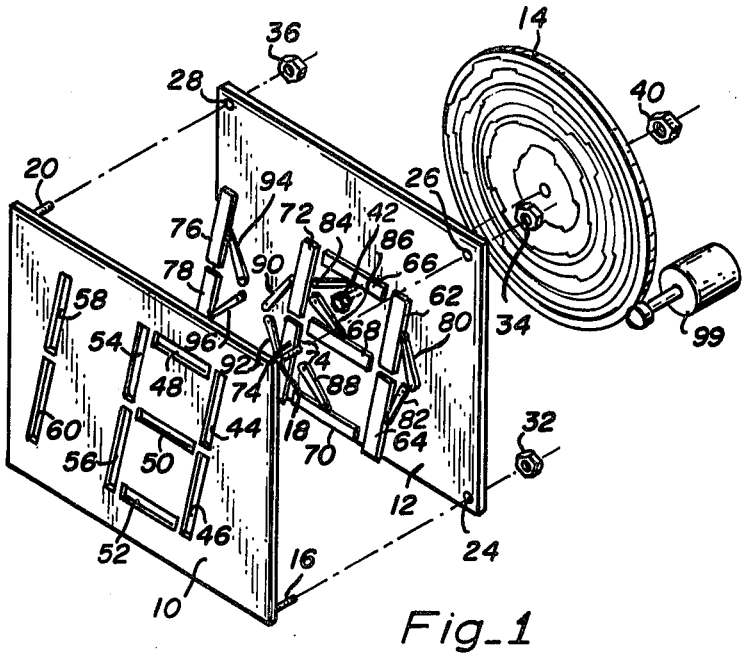

Referring now to FIG. 1, an exploded perspective view of the multiple shutter digital display device is shown having a substantially opaque face plate 10, a transparent shutter support plate 12, and a transparent rotary cam shutter actuator 14. Face plate 10 has four studs, 16, 18, 20 and, not shown, 22, which engage with holes 24, 26, 28 and, not shown, 30, respectively, to align the face plate with the support plate and to attach the two plates together by means of suitable nuts 32, 34, 36 and, not shown, 38 respectively. Plates 10 and 12 must be slightly spaced apart, either by spacers positioned on the stud or by increasing the diameter of studs towards their attachment point with plate 10 so that their increased diameters will not fit through the holes in plate 12. Alternatively, the face plates may be adhesively attached together, as long as the separation between the two plates is maintained with a suitable spacer. Cam 14 is rotatably attached to the back of plate 12 such as by a nut 40 and a bolt 42, although other means such as loosely riveting are also suitable.

Face plate 10 has formed through its surface a plurality of transparent segment windows 44, 45, 48, 50, 52, 54, 56, 58 and 60 which are usually uncolored and transparent but may be tinted if desired. In the present embodiment, segment windows 44–56 form a standard seven-segment display pattern and segment windows 58 and 60 form a standard "plus one". This is sometimes called a "digit-and-a-half" display pattern.

Situated on plate 12 are a plurality of shutters 62, 64, 66, 68, 70, 72, 74, 76 and 78. Shutters 62 through 78 when "closed" completely cover or opaque segment windows 44–50, respectively. The shutters are always opaque and are generally of the same color or shading as the opaque portion of face plate 10 so that the contrast between the two is very slight. A plurality of cam follower arms 80, 82, 84, 86, 88, 90, 92, 94 and 96, are associated with shutters 62–78, respectively. A first end of each of the cam follower arms is pivotally attached to a midlength edge of their respective shutters and the arms are further pivotally attached to the shutter support plate at a point between its ends but more proximate the second end. A second end of each of the cam follower arms is provided with a track following pin which extends through an aperture 98 in plate 12 to contact a unique grooved track in the cam shutter actuator.

Figure 2:
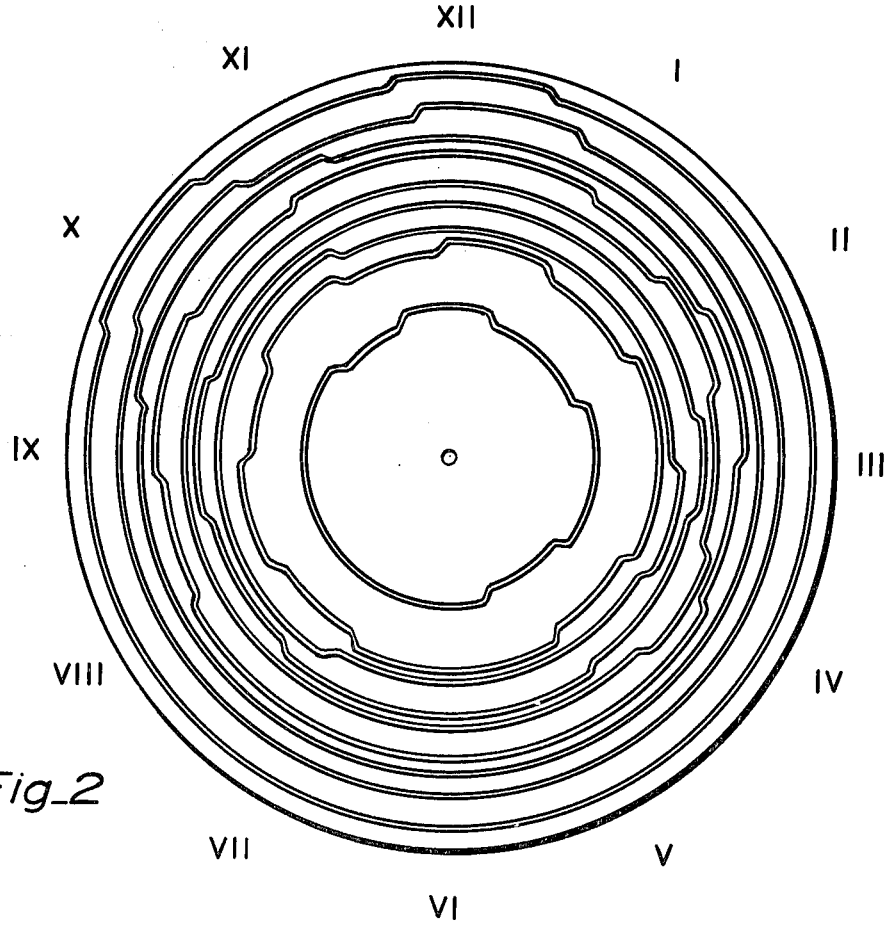

Referring now to FIG. 2, a plan view illustrating the grooves formed on the surface of the rotary cam shows that the cam, in this embodiment, is divided in pie-like fashion into 12 equal portions, each one of which corresponds to a digital display number between 1 and 12. If, for example, it were wished to have a digital display which varies between zero and nine, instead of one and twelve, the rotary cam would be divided into ten pie-like portions, or if it were decided to have a pair of seven segment displays to display numbers ranging between zero and ninety-nine, the rotary cam would be divided into one-hundred pie-shaped portions. Consequently, one rotary cam can, theoretically speaking, produce an appropriate display for any finite number by simply dividing the cam into the appropriate number of pie-shaped portions. However, the practically of the two full digit embodiment is questionable because of the mechanical complexity involved and can more easily be provided by two ganged single digit units.

The rotary cam, in the present embodiment, has a plurality of concentrically grooved tracks, a, b, c, d, e, f, g, h, and i formed on a surface. Each of grooves a–i correspond to one of the shutters and controls its opening and closing. This is because each of the concentric grooves, while generally circular, have their diameter varied at points about their circumference and thereby comprise a mechanical code or program for opening and closing the shutters. The cam follower arms are, in a sense, centrally pivotable levers, which amplify the motion of the end closer to the central pivotal point to the end farthest from the central pivotal point. The end closest to the center pivot is, of course, the end with the groove following pin and the end farthest from the pivot point is attached to the shutter.

The number of grooves on the cam surface corresponds to the number of shutters and segment windows in the display. For example, in the present embodiment, there are nine grooves, each one of which corresponds to and controls one of the shutters in the seven segment digital readout and one of the shutters in the plus one digital readout. If there were to be two seven segment readouts the number of grooved tracks would then be, of course, 14.

Figure 3:
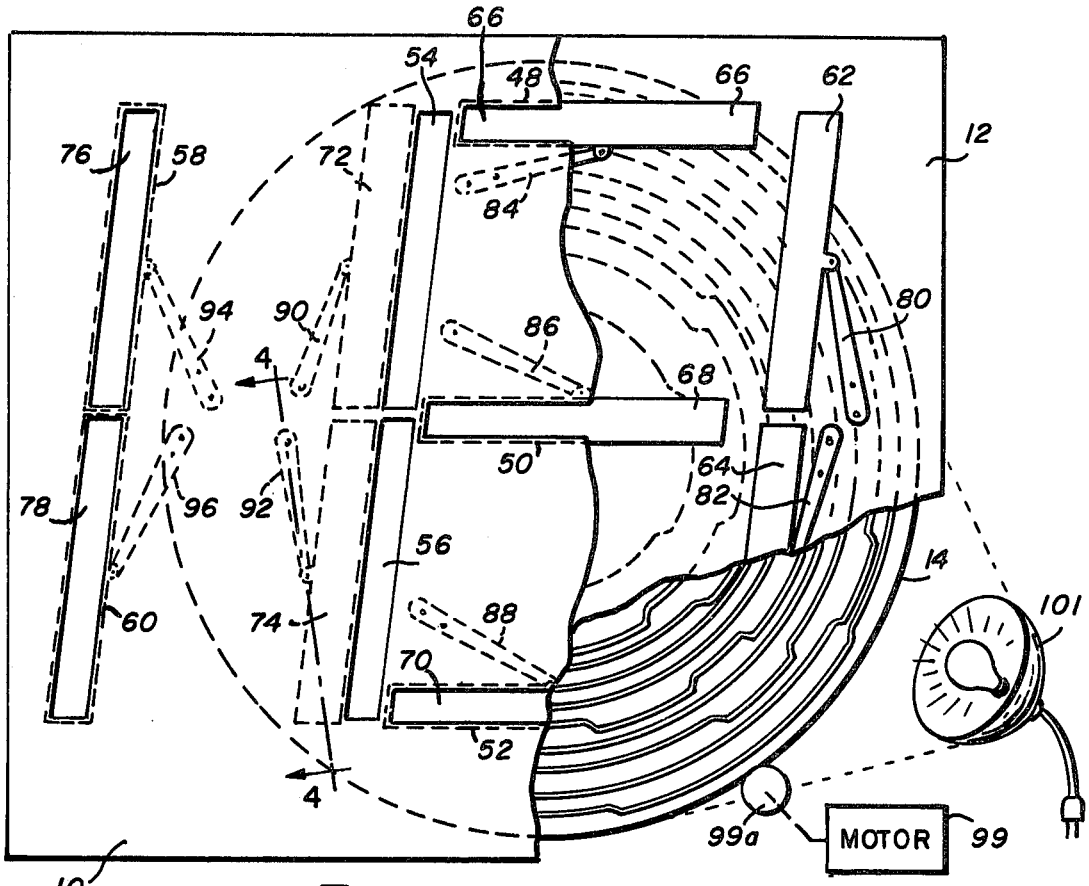

Referring now to FIG. 3, a partially cut away top plan view of the multiple shutter digital display device of the present invention with the shutters in position for displaying the numeral 11 is shown. Shutters 72 and 74 are shown retracted from windows 54 and 56, allowing the tinted transparent shutter support plate to be seen through the windows. The tinted support plate contrasts with the opaque face plate and clearly appears as a digit one. Similarly, shutters 62 and 64 are retracted, which allows tinted plate 12 to be seen through segment windows 44 and 46, not seen in this figure. Cam follower arm 82 may be seen to engage groove e of the rotary cam which, in this example, is causing shutter 64 to open.

An illumination means 101 is disposed behind transparent cam 14 and shutter support plate 12 so that light may shine through them and any unshuttered window to brightly illuminate the display.

A motor means 99 drives cam 14 by means of a drive wheel 99*a*. If the motor means causes the cam to rotate once every twelve hours, the digital display device will sequentially display the hours of the day.

Figure 4:
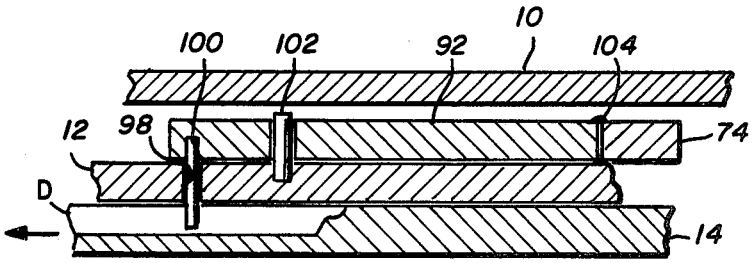

FIG. 4 is a partial sectional view taken along lines 4—4 of FIG. 3 and further serves to illustrate the action of the cam, cam following arm and shutter in the digital display of the present invention. Cam follower arm 92, shutter 74, and plate 12 form a two layered sandwich between face plate 10 and rotary cam 14. Follower arm 92 is pivotally attached to plate 12 by pivot 102. A track following pin 100 extends through an aperture 98 in plate 12 to engage groove d in the rotary cam. As the cam is rotated, pin 100 follows the meandering path of groove d and causes the following arm 92 to move in sympathy. The end of following arm 92 opposite from the end having the groove engaging pin is pivotally connected to shutter 74 such as by a loop of string 104. The motion of the cam follower arm at the pin end is transferred and exaggerated at its opposite end which is connected to the shutter. Thus, the groove has coded or programmed the information necessary to open the correct shutter at the correct time for the display of a digital numeral.

Figure 5:
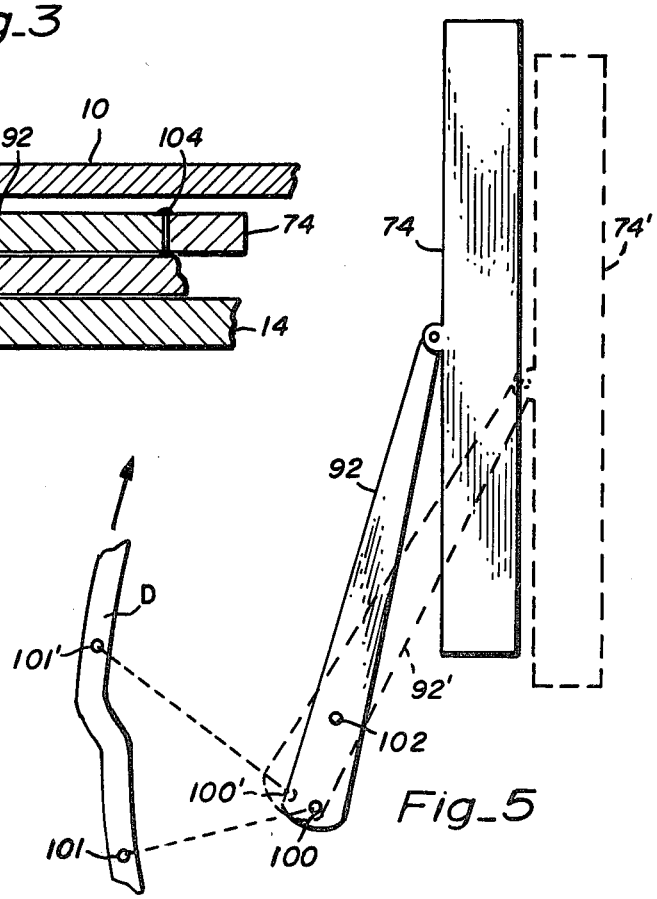

FIG. 5 is a partial top plan view in pictorial form further illustrating the action of the cam follower arm and shutter. Initially, the cam follower arm and shutter are in a position as indicated by 92′ and 74′. The follower arm guide pin 100′ is retained in grooved track at a position 101′. As the cam rotates, and the grooved track progresses, the guide pin is moved to a position 101, moving the follower arm to 92 and the shutter to 74, pulling the shutter away from its associated window. A new change in the groove's circumference will reposition the shutter to close its associated window.

The multiple shutter digital display device of the present invention is produced from lightweight plastics, but any suitable strong, lightweight material can be used. The cam and shutter support plate are transparent in the preferred embodiment so that illuminating light may be shined through them and out any unshuttered window producing a backlighted and highly visible display. In alternate embodiments where back lighting is not essential the shutter support plate need not be transparent. Moreover, the shutters can be colored to contrast with commonly colored face and support plate surfaces so that segments are displayed when the shutters are positioned to cover the windows.

As an additional alternative construction, either the face plate 10 or the support plate 12, or both, can be provided with wells or recesses for receiving the shutter and providing guides therefor. In such case the two plates can be laminated or otherwise fastened together with no separation therebetween.

Although the present invention has been described above with reference to a single, preferred embodiment, it is contemplated that many alterations and modifications will become apparent to those skilled in the art after having read this disclosure. For example, similar apparatus could be used to form alphanumeric characters as well as, or instead of digital characters. It is therefore intended that the appended claims be interpreted as covering all such alterations and modifications as fall within the true spirit and scope of the invention.

What is claimed is:

1. A multiple shutter digital display device comprising:

an opaque face plate having a patterned plurality of transparent segment windows provided therein;

a shutter support plate facing and disposed in proximal alignment behind said face plate;

a plurality of shutters, each of which is uniquely associated with one of said segment windows and is large enough to completely cover the associated window when aligned therewith, said shutters being disposed between said shutter support plate and said face plate;

a rotary cam having a plurality of concentric, substantially circular, grooved tracks formed upon a first surface, each of said tracks having portions about its circumference which vary in diameter, said cam being disposed in proximal facing alignment behind said support plate;

a plurality of cam follower arms, each of which are associated with one of said shutters, a first end of each of said arms being pivotally attached to a midlength edge of said associated shutter, a midportion of said arm being pivotally attached to said shutter support plate and a second end of said cam follower arm being provided with a track following pin extending through an aperture in said support plate to engage one of said tracks in said cam shutter actuator whereby said pins each follow one of said tracks as said cam is rotated, and the motion of said pin is transferred through the follower arm to open and close the associated shutter and thereby present a digital display to a viewer.

2. A multiple shutter digital display device as recited in claim 1 where said plurality of segment windows are patterned into a seven segment digital array.

3. A multiple shutter digital display device as recited in claim 1 wherein said shutter support plate and said rotary cam are transparent, and further comprising illumination means disposed behind said rotary cam whereby light from said illumination means passes through said cam, said shutter support plate and through unshuttered windows to produce a lighted digital display.

4. A multiple shutter digital display device as recited in claim 1 wherein said shutter support is tinted relative the face plate to provide a contrasting color variation with respect to the face plate as seen through a segment window.

5. A multiple shutter digital display device as recited in claim 1 and further comprising motor means for rotating said rotary cam.

6. A multiple shutter digital display device as recited in claim 1 and further comprising rotary connection means connecting said cam to said shutter support plate.

7. A multiple shutter digital display device as recited in claim 1 and further comprising spacing means disposed between said shutters support and said face plate so as to provide a free space within which said shutters are moveable.

8. A multiple shutter digital display device as recited in claim 1 wherein said midportion pivotally attached to said shutter support plate is proximate said second end.

9. A multiple shutter digital display device as recited in claim 1 wherein said plurality of segment windows are patterned into a seven segment digital array and a two segment unit digit, and wherein said rotary cam has nine tracks, the outer two of which are respectively associated with the shutters of said unit digit, and the innermost eight tracks are respectively associated with the shutters of said seven segment digital array.

10. A segmented character display device comprising:

means forming a face plate having a patterned plurality of windows provided therein;

means forming a shutter support plate disposed behind said face plate;

means forming a plurality of individual shutters, each of which is uniquely associated with one of said windows and is large enough to completely cover the associated window when aligned therewith, said shutters being disposed between said shutter support plate and said face plate;

means forming a rotary cam having means forming a plurality of concentric, substantially circular tracks, each of said tracks having portions about its circumference which vary in diameter, said cam being disposed behind said support plate;

means forming a plurality of shutter actuating arms, each of which are associated with one of said shutters and have a first end pivotally attached thereto, each said arm being provided with a track following pin extending through an aperture in said support plate to engage one of said tracks, whereby said pins each follow one of said tracks as said cam is rotated and the motion of said pins cause their associated actuating arms to open and close the respective shutters and thereby present a different character display for each of a plurality of angular positions of said cam.

* * * * *